United States Patent [19]

Gassman

[11] Patent Number: 4,498,846

[45] Date of Patent: Feb. 12, 1985

[54] STROKE CONTROL VALVE

[75] Inventor: Max P. Gassman, Waterloo, Iowa

[73] Assignee: Deere & Company, Moline, Ill.

[21] Appl. No.: 505,676

[22] Filed: Jun. 20, 1983

[51] Int. Cl.[3] ..... F04B 49/00

[52] U.S. Cl. ..... 417/214; 417/216

[58] Field of Search ..... 417/214, 216, 221; 60/447, 452, 428

[56] References Cited

U.S. PATENT DOCUMENTS 3,985,472 10/1976 Virtue et al. ..... 417/216

3,995,973 12/1976 Ring et al. ..... 417/214

*Primary Examiner*—Edward K. Look

[57] ABSTRACT

A pump displacement control valve alternately connects charge pressure and pump output high pressure to the displacement control chamber of a variable displacement pump and includes a check valve which prevents high pressure fluid from entering the charging circuit.

8 Claims, 1 Drawing Figure

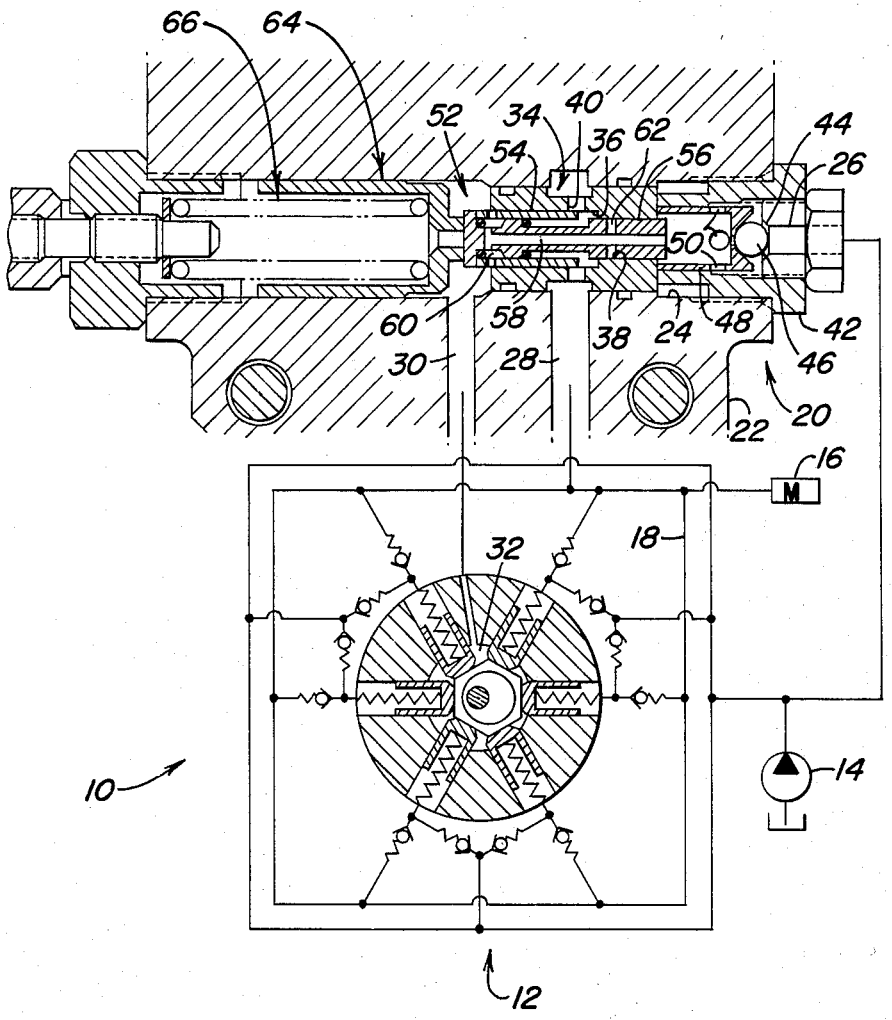
66
64
52
34
40
36
62
54
56
44
26
50
60
58
38
24
48
42
46
30
28
20
22
16
M
18
32
10
14
12

STROKE CONTROL VALVE

BACKGROUND OF THE INVENTION

This invention relates to a stroke control valve for a variable displacement reciprocating piston device, and in particular, a radial piston pump.

It is known that the displacement of a radial piston pump can be controlled by controlling the fluid pressure in its interior or stroke control chamber. This concept is illustrated in U.S. Pat. No. 3,002,462 to Raymond. One prior art method of accomplishing this has been to meter high pressure pump output pressure back to the stroke control chamber to reduce the pump output when the output pressure is too high. However, energy usage can be reduced by flowing low pressure oil to the stroke control chamber during standby conditions instead of continuously communicating high pressure fluid to it. A valve which performs this function is described in U.S. Pat. No. 3,526,468 issued to Moon et al, and assigned to the assignee of the present invention. However, the valve of U.S. Pat. No. 3,526,468 also permits high pressure oil to flow into the charge pump circuit, thus reducing the rapidity of pump de-stroking.

SUMMARY OF THE INVENTION

An object of the present invention is to provide a pump displacement control valve which permits rapid pump de-stroking.

Another object of the present invention is to provide a pump displacement control valve which reduces energy usage.

These and other objects are achieved by the present invention which includes a valve housing with a valve bore with ports connected to a charge pump, to the outlet of a variable displacement pump and to the stroke control chamber of the variable displacement pump. A valve member is movable in the bore between a first position connecting charge pressure to the stroke control chamber and a second position connecting pump output pressure to the stroke control chamber. A check valve prevents high pressure fluid from flowing into the charge circuit when the valve member is in its second position.

BRIEF DESCRIPTION OF THE DRAWING

The FIGURE is a schematic and sectional view of a pump system, including the present invention.

DETAILED DESCRIPTION

The hydraulic system 10 includes a conventional variable displacement radial piston pump 12, such as is described in U.S. Pat. No. 3,002,462 issued to Raymond in 1961. The pump 12 receives charge pressure from a charge pump 14 and supplies high pressure fluid to a hydraulic function or motor 16 via line 18.

The stroke control valve 20 has a housing 22 which includes a valve bore 24, a first inlet 26 communicating with the charge pump 14, a second inlet 28 communicating with high pressure pump output line 18 and an outlet 30 communicating with the stroke control chamber 32 of the pump 12.

The valve bore 24 sealingly receives a hollow sleeve 34 which has large and small bore portions 36 and 38, respectively, and a radial passage 40 which communicates fluid from second inlet 28 into the interior of large diameter bore 36.

The inlet 26 extends through a fitting 42 which has a check valve seat 44 formed thereon. A check valve ball 46 is engageable with seat 44 to prevent fluid flow from valve 20 back to charge pump 14. A cylindrical ball retainer 48 is mounted within fitting 42 and holds the ball near seat 44, while freely permitting flow from charge pump 14 into valve 20 via the annular space between retainer 48 and fitting 42 and radial passages 50.

A cylindrical valve member 52 is slidably mounted within the sleeve 34 and includes a large diameter portion 54 which slides in large bore 36 and a stem or small diameter portion 56 which slides in bore 38. A blind axial bore 58 extends into valve member 52 from an end of the small diameter portion. Radial passages 60 communicate bore 58 with the outer surface of large diameter portion 54. Radial passages 62 communicate bore 58 with the outer surface of stem 56.

A sleeve 64 engages the valve member 52 and both the sleeve 64 and valve member 52 are urged to the right by spring 66 towards a position wherein passages 62 are blocked by the wall of bore 38 so that high pressure fluid from second inlet 28 cannot flow through valve 20 to outlet 30 and stroke control chamber 32.

When the output pressure of pump 12 increases to a certain level, this pressure acting upon the larger diameter portion 54 will move valve member 52 to the left and open radial passages 62 to the pump outlet pressure from second inlet 28. This high pressure fluid then flows via bore 58, passages 50 and outlet 30 to stroke control chamber 32, thus de-stroking pump 12 and reducing or limiting its output pressure. At the same time, this high pressure fluid flows through retainer 48 and seats ball 46 against seat 44, thus preventing high pressure fluid from flowing back from valve 20 to charge pump 14. Thus, this valve provides low pressure charge fluid to the stroke control chamber 32 during standby conditions and provides high pressure fluid for rapid de-stroking of pump 12 while preventing high pressure fluid from entering the charging circuit.

While the invention has been described in conjunction with a specific embodiment, it is to be understood that many alternatives, modification and variations will be apparent to those skilled in the art in light of the aforegoing description. Accordingly, this invention is intended to embrace all such alternatives, modifications and variations which fall within the spirit and scope of the appended claims.

I claim:

1. A stroke control valve for controlling communication of stroke control fluid pressure to a stroke control chamber of a main reciprocating piston pump which receives charge fluid from a charge pump, the stroke control valve comprising:

a housing defining a valve bore therein, a charge port communicating an end of the valve bore with an outlet of the charge pump via a first passage, a main port communicating working fluid from an outlet of the main pump to the valve bore via a second passage and an outlet port communicating the valve bore to the stroke control chamber via a third passage;

a valve member which cooperates with a wall of the valve bore and is movable in the valve bore between a first position blocking fluid communication of the working fluid from the main port to the outlet port and permitting communication of charge fluid from the charge port through the valve bore to the outlet port and a second position communicating the working fluid from the main port through the valve bore to the outlet port; and a check valve in the charge port, the check valve permitting fluid flow from the charge port to the outlet port via the valve bore when the valve member is in its first position, the check valve blocking fluid flow from the main port to the charge pump when the valve member is in its second position.

2. The stroke control valve of claim 1, wherein:

the valve member is movable in the bore in response to fluid pressure changes in the main port; and a resilient member biases the valve member toward its first position.

3. The stroke control of claim 2, wherein:

the valve bore comprises larger and smaller diameter bores, the larger bore being communicated at one end to one end of the smaller bore and at its other end to the outlet port, the smaller bore being communicated at its other end to the charge port via the check valve, the main port communicating with the larger bore via a radial passage which intersects the larger bore; and the valve member comprising a cylindrical body having a first part slidably and sealingly engaging a wall of the larger bore and a second part projecting axially from the first part and slidably and sealingly engaging a wall of the smaller bore, the body having a central passage extending axially therein from an outer end of the second part at least partially into the first part, the first part having a first radial passage communicating the central passage with the outlet port, the second part having a second radial passage extending therethrough and intersecting the central passage, the wall of the smaller bore and the second part cooperating to prevent communication between the main port and the second radial passage when the valve member is in the first position, and the second radial passage being open to the main port when the valve member is in the second position.

4. The stroke control valve of claim 3, wherein the check valve comprises:

a valve seat formed by a wall of the valve bore;

a check ball in the valve bore; and a ball retainer in the valve bore for maintaining the check ball near the valve seat, the retainer having a hollow body with radial passages for allowing fluid flow therethrough from the charge port to the outlet port when the valve member is in its first position.

5. The stroke control valve of claim 3, wherein:

the second part comprises an inner member having a head and a stem, the head being coupled to the resilient member, the stem having the central passage extending therein and slidably and sealingly engaging the wall of the smaller bore; and the first part comprises a hollow cylindrical outer member coaxially receiving the inner member.

6. A fluid system, comprising:

a variable displacement pump having an inlet, an outlet and a stroke control chamber;

a charge pump for supplying charge fluid to the main pump inlet; and a stroke control valve for controlling fluid pressure in the stroke control chamber, the stroke control valve comprising:

a housing defining a valve bore therein, a charge port communicating the valve bore with an outlet of the charge pump via a first passage, a main port communicating the main pump outlet to the valve bore via a second passage and an outlet port communicating the valve bore to the stroke control chamber via a third passage;

a pressure-responsive valve member movable in the valve bore between a first position wherein fluid communication between the main port and the outlet port is blocked and wherein fluid communication between the charge port and the outlet port is open and a second position wherein the main port is communicated with the outlet port, the valve member being movable in the valve bore between the first and second positions in response to changes in the fluid pressure in the main port;

a resilient member biasing the valve member towards its first position; and a check valve in the charge port for preventing fluid communication from the main port to the charge pump when the valve member is in the second position.

7. The stroke control valve of claim 6, wherein:

the valve bore comprises larger and smaller diameter bores, the larger bore being communicated at one end to one end of the smaller bore and at its other end to the main port, the smaller bore being communicated at its other end to the charge port via the check valve, the main port communicating with the larger bore via a radial passage in the housing which intersects the larger bore; and the valve member comprising a cylindrical body having a first part slidably and sealingly engaging a wall of the larger bore and a second part projecting axially from the first part and slidably and sealingly engaging a wall of the smaller bore, the body having a central passage extending axially therein from an outer end of the second part at least partially into the first part, the first part having a first radial passage communicating the central passage with the outlet port, the second part having a second radial passage extending therethrough and intersecting the central passage, the wall of the smaller bore and the second part cooperating to prevent communication between the main port and the second radial passage when the valve member is in the first position, and the second radial passage being open to the main port when the valve member is in the second position.

8. The stroke control valve of claim 7, wherein the check valve comprises:

a valve seat formed by a wall of the valve bore;

a check ball in the valve bore; and a ball retainer in the valve bore for limiting movement of the check ball away from the valve seat, the retainer having a hollow body with radial passages for allowing fluid flow therethrough from the charge port to the outlet port when the valve member is in its first position.

* * * * *